United States Patent [19]

Long

[11] Patent Number: 4,563,851

[45] Date of Patent: Jan. 14, 1986

[54] BRACING FOR STUDWALLS

[75] Inventor: Charles E. Long, Jacksonville, Fla.

[73] Assignee: Altech Industries, Inc., Jacksonville, Fla.

[21] Appl. No.: 662,034

[22] Filed: Oct. 18, 1984

[51] Int. Cl.[4] ..... E04C 2/38; E04C 3/18

[52] U.S. Cl. ..... 52/656; 52/696; 52/693

[58] Field of Search ..... 52/656, 657, 693, 695, 52/696, 653

[56] References Cited

U.S. PATENT DOCUMENTS

| | | | |
|---|---|---|---|
| 1,649,226 | 11/1927 | Gstalder | 52/DIG. 4 |
| 2,302,101 | 11/1942 | Boydstun | 52/657 |
| 2,963,127 | 12/1960 | Manville | 52/693 |
| 3,332,196 | 7/1967 | Tuttle | 52/696 |
| 4,016,698 | 4/1977 | Rogers | 52/693 |
| 4,339,903 | 7/1982 | Menge | 52/693 |

*Primary Examiner*—James L. Ridgill, Jr.
*Attorney, Agent, or Firm*—Arthur G. Yeager

[57] ABSTRACT

The combination of a wooden stud wall and a diagonally positioned thin flat metal brace nailed to said wall and bent around diagonally opposite corners of the wall and nailed into the ends of the top plate and of the sole plate and to the stud adjoining the sole plate.

12 Claims, 6 Drawing Figures

BRACING FOR STUDWALLS

BACKGROUND OF THE INVENTION

Wooden stud walls, comprising a horizontal sole plate and a horizontal top plate separated by a plurality of spaced vertical studs, are common components of most residential homes. The generally rectangular structure is inherently easily distortable when forces are applied in the plane of the wall at any angle to the vertical studs. Triangular structures are well known to be inherently rigid and not distortable, and accordingly, the employment of a diagonal bracing to stiffen a rectangular stud wall is also well known. The difficulty with applying a diagonal bracing to a stud wall is that the bracing must not interfere with the subsequent fastening of siding, wallboard, insulation, or the like to the stud wall. The attachment of a diagonal plank to a stud wall is, therefore, not feasible because it would interfere with the smooth subsequent placement of siding, wall board, or the like. The internal attachment of a diagonal brace (not projecting beyond the two faces of the stud wall) is much too time consuming and expensive to be commercially acceptable. One solution to this problem has been the use of a thin flat metal strap as a brace since its thinness does not obstruct the subsequent attachment of siding, wallboard, or the like. An improvement on such a bracing is described in U.S. Pat. No. 4,016,698 to Rogers wherein the bracing strap is bent over and nailed to the top surface of the top plate and also bent over and nailed to the bottom surface of the sole plate. This arrangement provides a much stronger structure than merely the flat brace nailed only to one face of the stud wall. While this arrangement is stronger than its predecessor arrangement, it still does not provide all of the strength that is readily available by such a bracing.

It is an object of this invention to provide a novel bracing for wooden stud walls. It is another object of this invention to provide an improved attachment to provide extra strength to a braced stud wall. Still other objects will be apparent from the detailed description which follows.

BRIEF DESCRIPTION OF THE INVENTION

This invention relates to the combination of a generally rectangular wooden stud wall for a building and a diagonal brace for tensile loading to prevent the wall from being distorted under a racking load. The stud wall includes a horizontal top plate and a horizontal sole plate fastened to the respective ends of spaced vertical studs, including end studs joining the respective ends of said top plate and said sole plate and forming a plane in which lies the adjoining ends of the top plate or sole plate. The brace is an elongated flat metal strap having over its entire length a plurality of spaced holes for attaching the strap to the plates and to the studs with fasteners. The strap extends diagonally across the wall from an upper corner, including the end of said top plate, to the opposite lower corner including the opposite end of the sole plate and the lower end of the adjoining end stud. The brace is bent at each end substantially 90° to lie against the end of said top plate and to lie against the end of the sole plate and the adjoining end stud. Fasteners are applied through the holes in the brace to attach it to the studs, to the end of the top plate, and to the end of the sole plate and its adjoining end stud.

In a specific embodiment the brace is a thin flat metal strap of 16–18 gauge thickness and 1.5–2.5 inches wide, and the strap is bent at each end and nailed to the end of the respective plate and to its adjoining stud.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
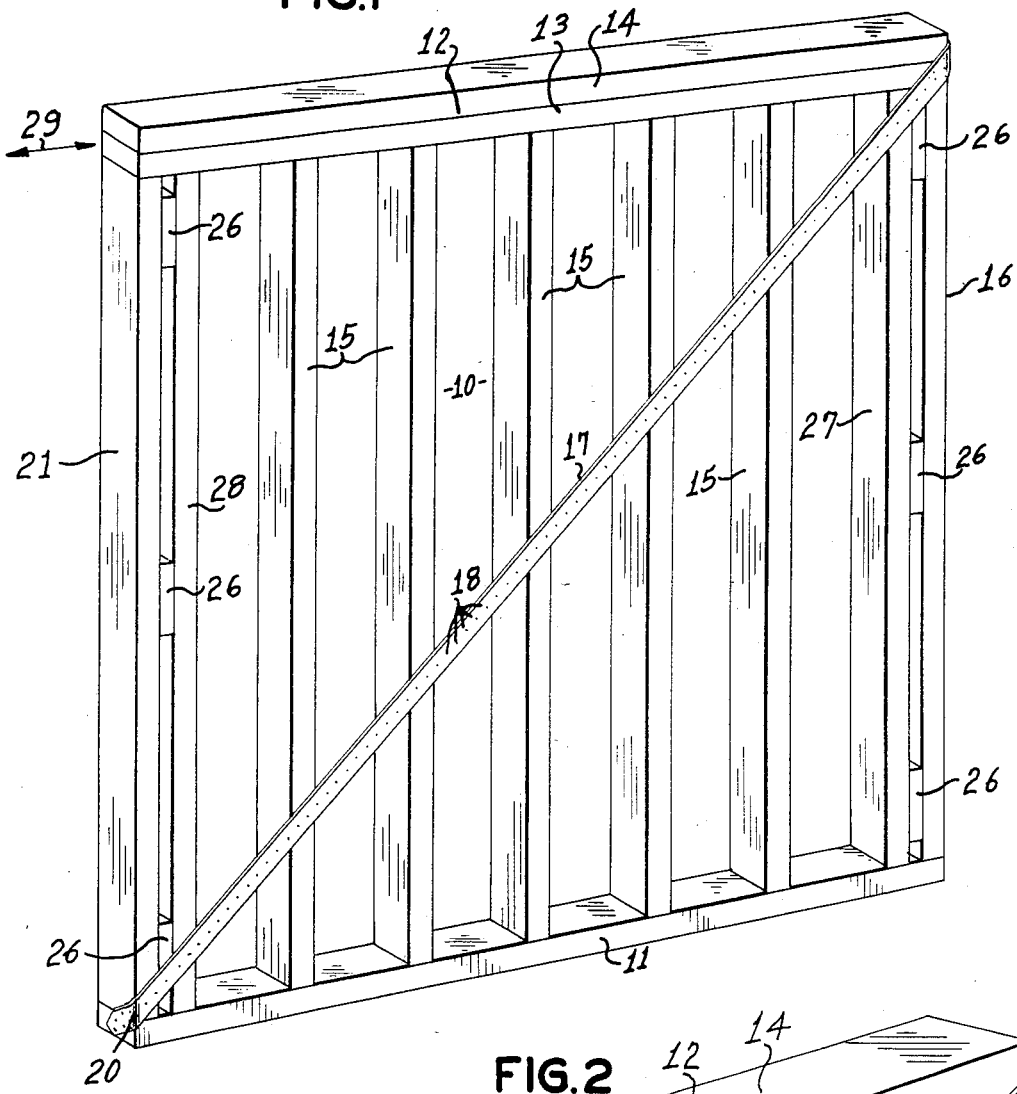
FIG. 1 is a perspective view of a wooden stud wall with the bracing of this invention.

In the drawings there is shown the normal stud wall found in most buildings. Stud wall 10 comprises horizontal sole plate 11, horizontal top plate 12, and vertical spaced studs 15. All component pieces of stud wall 10 are normally 2×4 inch lumber nailed or screwed together with studs 15 spaced at about 14–18 inches. Sole plate 11 and top plate 12 may each be a single 2×4 beam or may for additional strength be made of two abutting pieces of 2×4 beam, although the standard construction requires a single beam for sole plate 11 and two abutting beams for top plate 12. Similarly the end studs are frequently doubled for additional strength and for convenience in inserting frames for doors or windows. In FIG. 1 the top plate 12 is shown as being comprised of lower beam 13 and upper beam 14 abutting each other over their entire lengths. Sole plate 11 is shown as a single 2×4 beam. End studs 16 and 21 are each shown to be reinforced by studs 27 and 28, respectively, spaced apart by 1-inch spacers 26. In nearly all instances, stud wall 10 is quadrilateral, usually rectangular.

The stability of a quadrilateral structure is well known to be weak when subjected to distorting forces. For example, if in FIG. 1 sole plate 11 is rigidly affixed to a base and forces are applied to top plate 12 in the directions of arrow 29, stud wall 10 will distort to a diamond shaped parallelogram under mild forces. This distortion will occur under forces lying generally in the plane of stud wall 10 and applied in any direction other than vertical, which is parallel to the long axis of studs 15. Triangles have long been known to be stable against such distortion, and accordingly, it is a common practice to stiffen a rectangular structure (such as stud wall 10) by affixing a diagonal component to the vertical and horizontal components, particularly to the outside components, of the structure. This forms a plurality of triangles which are structurally strong. In the case of a house where stud walls are subjected to a variety of forces (roof load, wind, snow, etc.) it is imperative that stud walls be strengthened against distortion. In some instances this is accomplished by affixing a sheathing (e.g. plywood) over the stud wall. In other instances, e.g., where the sheathing is wallboard, other means must be found to stiffen stud wall 10.

In the present invention the problem of stiffening a stud wall 10 is accomplished by affixing thereto a diagonal bracing strap, preferably of galvanized steel about 16–18 gauge in thickness and about 1.5–2.5 inches wide. The improvement of this invention is that one end of the bracing strap is bent around the end of the sole plate and the other end of the bracing strap is bent around the end of the top plate at opposite corners of the stud wall. In FIG. 1 it is seen that bracing strap 17 is placed diagonally across stud wall 10 from the upper right hand corner to the lower left hand corner and fastened to each stud 15 through holes 18. The fasteners are normally nails, although screws are equally operable. If possible each stud 15 is fastened to strap 17 through two holes 18 by two fasteners. At its upper end, strap 17 is bent at 19 around to lie flat against the end of top plate 12, in this instance against the ends of both of beams 13 and 14. At the lower corner, bracing strap 17 is bent at 20 around to lie flat against the end of sole plate 11 and the adjoining face of end stud 21. Bracing strap 17 is fastened by nails or screws into the ends of beams 13 and 14 at the top end, and into beam 11 and stud 21 at the bottom end.

Figure 2:
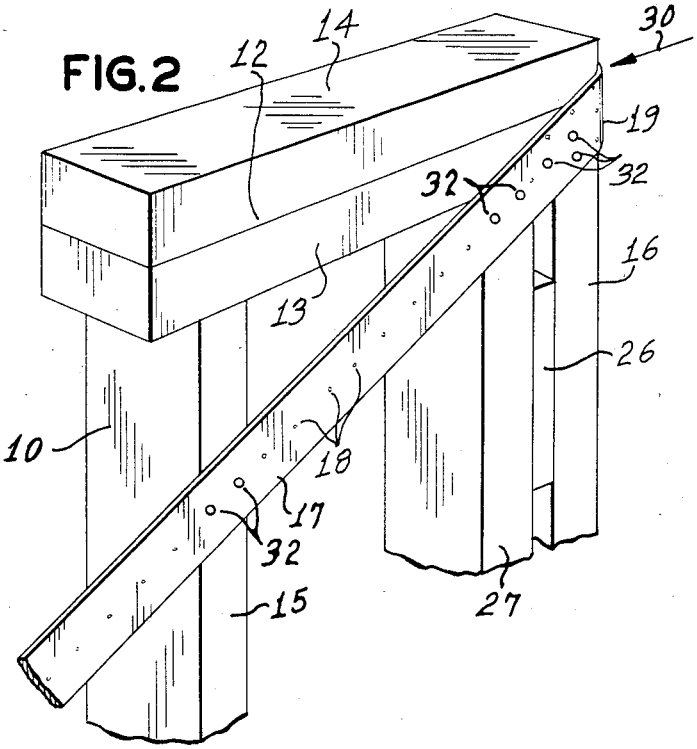
FIG. 2 is an enlarged partial view in perspective of the stud wall where the bracing attaches to the top plate.
Figure 3:
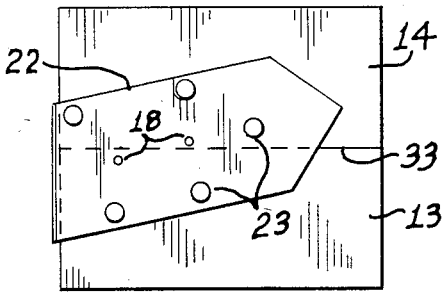
FIG. 3 is an end elevational partial view of the bracing as positioned on the end of the top plate.

In FIGS. 2 and 3 there is shown an enlargement of the upper corner of stud wall 10 where bracing strap 17 is bent at 19 around the ends of beams 13 and 14 of top plate 12. FIG. 3 is a view taken in the direction of arrow 30. Strap 17 is nailed at 32 to studs 15 and 27 and to beam 13 through any convenient nail holes 18. Strap 17 is then hammered around the corner at 19 to make the strap lie flat against the end of top plate 12. In this instance, where top plate 12 comprises two abutting beams 13 and 14, strap 17 will be lying against the ends of beams 13 and 14 and preferably will overlap the abutting surface 33 so as to be nailed at 23 into both beams 13 and 14. If top plate 12 comprised only a single 2×4 beam, strap 17 would preferably be bent at 19 so as to overlap the abutting surface between beam 13 and end stud 16 and be nailed to both pieces.

Figure 4:
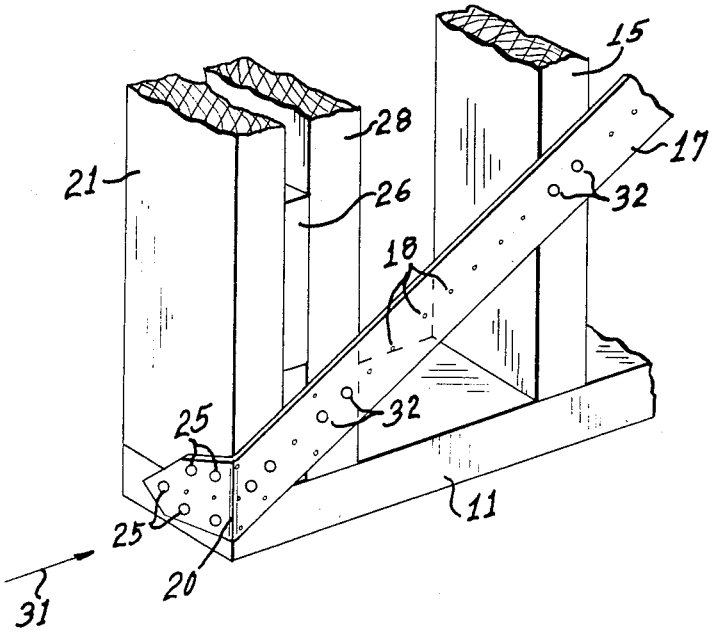
FIG. 4 is an enlarged partial view in perspective of the stud wall where the bracing attaches to the sole plate.
Figure 5:
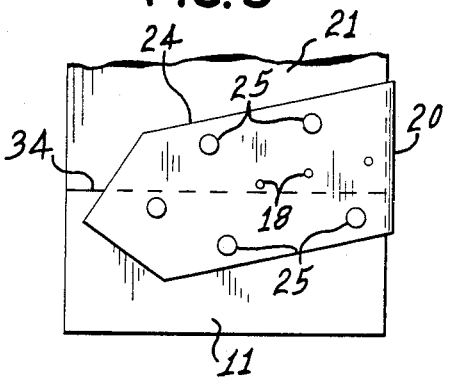
FIG. 5 is an end elevational partial view of the bracing as positioned on the end of the sole plate.

In FIGS. 4 and 5 there is shown an enlargement of the lower corner of stud wall 10 where bracing strap 17 is bent at 20 around the end of sole plate 11. FIG. 5 is a view taken in the direction of arrow 31. Strap 17 is nailed at 32 to studs 15, 28, and 21 through any convenient nail holes 18. Strap 17 is then hammered around the corner at 20 to make the strap lie flat against the end of sole plate 11 and against the adjoining face of stud 21. Strap 17 is bent to overlap over abutting surface 34 so as to permit it to be nailed at 25 to stud 21 and to the end of sole plate 11.

Figure 6:
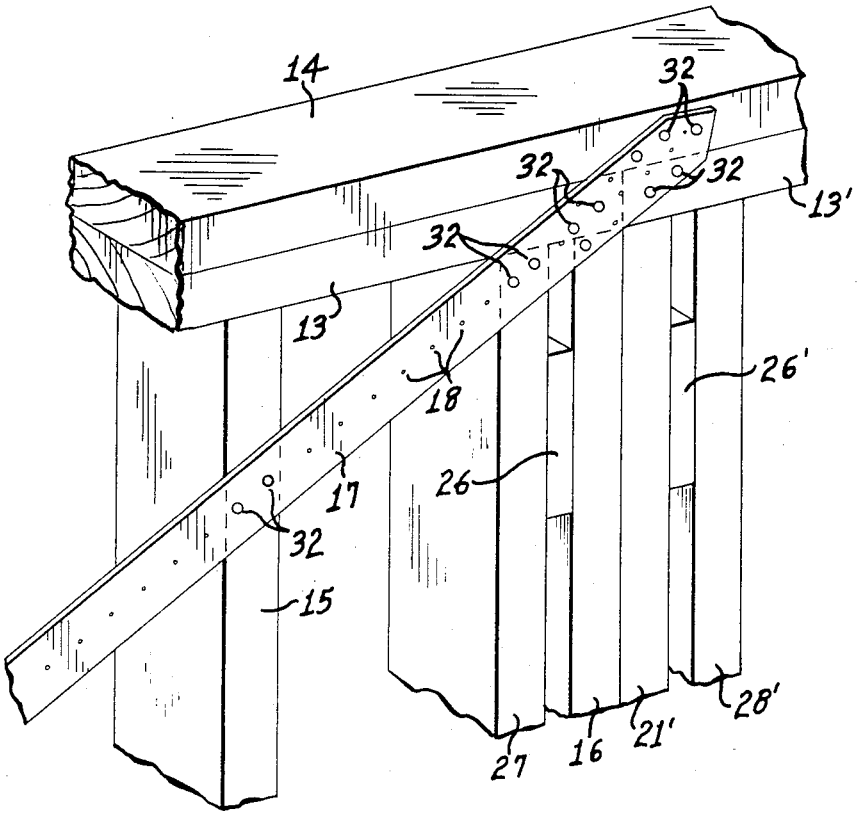
FIG. 6 is a view similar to that of FIG. 2 showing two abutting walls employing the bracing of this invention.

In FIG. 6 there is shown an embodiment in which two stud walls are joined end-to-end so as to produce a longer wall. One stud wall having end stud 16 is abutted against another stud wall having an end stud 21'. In this instance each stud wall has a single top plate 13 and 13' respectively which abut each other at the ends of top plate 13 and 13'. In order to employ a double beam top plate, beam 14 is attached to the top of beams 13 and 13'. A preferred construction for this structure is for beam 14 to extend across the junction of beams 13 and 13' and be attached to both of beams 13 and 13' so as to produce a stronger structure. Brace 17 which is only long enough to stretch across one stud wall must be attached differently than described above with respect to FIGS. 1–5. In this instance the lower end of brace 17 is attached to the sole plate and its adjoining end stud exactly the same as described above and shown in FIGS. 4 and 5. The upper end of brace 17, however, cannot be bent around the end of top plate 13, and, instead, is applied to the face of both stud walls at the junction of beams 13 and 13' by fastening to beams 13, 13' and 14 as well as to end studs 16 and 21', if possible.

Wooden stud walls made in accordance with this invention were tested under a racking load to determine strengths against distortion. The tests were made in accordance with the procedures of American Standard Testing Methods (ASTM) E72-80. Stud walls were made of #1 Douglas Fir Larch 2"×4" with studs on 16" centers and constructed as shown in FIG. 1. The face of the wall was 8 ft.×8 ft. The brace used was 16 gauge galvanized steel 2" wide by 12 ft. long and it was attached as shown above in FIGS. 1–5 using 16d nails. The brace was nailed to each vertical stud using two nails and the bent ends of the brace was attached to the top plate and to the sole plate using five nails each as shown in FIGS. 3 and 5. Three identical walls were tested under an increasing racking load from 0 to 4000 pounds. The load was increased in 200 pound increments up to 1200 pounds, then dropped to 0 and then brought back to 1400 and subsequently increased in 200 pound increments to 2400 pounds. The load was then again dropped to 0 and then brought back to 2600 and thereafter increased in 200 pound increments to a final load of 4000 pounds. The deflection in inches of each of the three stud walls was measured at each load as described above. The results are shown in Table I.

TABLE I

| | HORIZONTAL DEFLECTION - INCHES | | |
|---|---|---|---|
| Racking Load Pounds | Wall #1 | Wall #2 | Wall #3 |
| 0 | 0.000 | 0.000 | 0.000 |
| 200 | 0.033 | 0.036 | 0.040 |
| 400 | 0.057 | 0.066 | 0.082 |
| 600 | 0.091 | 0.115 | 0.135 |
| 800 | 0.138 | 0.160 | 0.207 |
| 1000 | 0.184 | 0.196 | 0.288 |
| 1200 | 0.236 | 0.266 | 0.379 |
| 0 | 0.056 | 0.066 | 0.090 |
| 1400 | 0.284 | 0.310 | 0.459 |
| 1600 | 0.334 | 0.346 | 0.558 |
| 1800 | 0.390 | 0.402 | 0.639 |
| 2000 | 0.448 | 0.457 | 0.743 |
| 2200 | 0.509 | 0.515 | 0.828 |
| 2400 | 0.559 | 0.564 | 0.988 |
| 0 | 0.192 | 0.201 | 0.249 |
| 2600 | 0.629 | 0.638 | 1.063 |
| 2800 | 0.704 | 0.709 | 1.135 |
| 3000 | 0.781 | 0.798 | 1.256 |
| 3200 | 0.861 | 0.879 | 1.436 |
| 3400 | 0.979 | 1.029 | 1.562 |
| 3600 | 1.130 | 1.280 | 1.801 |
| 3800 | 1.317 | * | 1.987 |
| 4000 | * | | * |

*No higher load could be achieved.

When the above test results are compared to those of U.S. Pat. No. 4,016,698 (Table I) the improved performance of this invention can be appreciated. Test No. 2 is for a wall braced with the same size brace, but attached as shown in U.S. Pat. No. 4,016,698. The racking load which produced 0.5 deflection is 1230 pounds and the wall failed at 3131 pounds. The present invention shows a 0.5 deflection at 2200 pounds (Wall #1 and Wall #2) and 1600 pounds (Wall #3). None of Walls #1, 2, or 3 failed at 4000 pounds. The highest test results of the patent are for Test No. 7 employing a 2.5 inch strap where a deflection of 0.5 inch required a racking load of 1350 pounds and the wall failed at 3355 pounds. If the above results are averaged as in the patent the present structure requires 2000 pounds to produce a 0.5 inch deflection. This is a 63% increase in strength over the patent structure (Test No. 2).

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. In combination a generally rectangular wooden stud wall for a building and a diagonal brace for tensile loading to prevent the wall from being distorted under a racking load, the stud wall including a horizontal top plate and a horizontal sole plate fastened to the respective ends of spaced vertical studs, including end studs joining the respective ends of said top plate and said sole plate and having outer planar surfaces substantially coplanar with the planar surfaces of said ends of said top and said sole plates, the brace comprising an elongated flat metal strap having over its entire length a plurality of spaced holes therethrough for attaching said strap to said plates and said studs with fastening means, said strap extending diagonally across said wall from an upper corner thereof, including the end of said sole plate and the lower end of the adjoining end stud, said brace being bent adjacent each end thereof substantially 90° to lie against said planar surface of said end of said top plate and against said planar surface of said end of said sole plate and against the contiguous planar surface of said adjoining end stud; and fastening means attaching said brace to said studs and attaching said bent ends of said brace to said ends of said top plate and of said sole plate and said adjoining stud at said planar surfaces.

2. The combination of claim 1 wherein said sole plate comprises a single wooden beam.

3. The combination of claim 1 wherein each said end stud is reinforced by being fastened to the next adjacent vertical stud in said wall through spacer blocks which maintain said end stud and said vertical stud at a spacing of less than the thickness of either of said studs.

4. The combination of claim 1 wherein said bent end of said brace at said lower corner is attached by said fastening means to said end of said sole plate and to said contiguous planar surface of said adjoining end stud.

5. The combination of claim 1 wherein said fastening means are nails.

6. The combination of claim 1 wherein said brace is attached to each of said vertical studs by said fastening means.

7. The combination of claim 1 wherein said brace is attached to each of said vertical studs by two nails.

8. The combination of claim 1 wherein said top plate comprises two coextensive wooden beams with the ends thereof being coplanar with said outer planar surfaces of said respective end studs.

9. The combination of claim 8 wherein said bent end of said brace at said upper corner is attached by said fastening means to the coplanar ends of both of said beams.

10. In combination a generally rectangular wooden stud wall for a building and a diagonal brace for tensile loading to prevent the wall from being distorted under a racking load, the stud wall including a horizontal top plate of two beams placed one on top of the other and a horizontal sole plate of a single beam fastened to the respective ends of spaced vertical studs, including end studs joining the respective ends of said top plate and said sole plate, the brace comprising an elongated flat metal strap having over its entire length a plurality of spaced holes therethrough for attaching said strap to said plates and said studs with fastening means, said strap extending diagonally across said wall from said horizontal top plate to the opposite lower corner thereof including the opposite end of said sole plate and the lower end of said end stud adjoining said sole plate, said brace being bent at one end thereof to lie against and be attached to the end of said sole plate and to the contiguous end of said end stud and at the other end thereof to be attached to both beams of said top plate.

11. The combination of claim 10 wherein said fastening means are nails.

12. The combination of claim 10 wherein said brace is galvanized steel of 16–18 gauge thickness and about 1.5–2.5 inches wide.

* * * * *